United States Patent [19]

Collin

[11] 4,079,185

[45] Mar. 14, 1978

[54] METHOD AND APPARATUS FOR THE MELT REDUCTION OF IRON OXIDES

[75] Inventor: Per Harald Collin, Falun, Sweden

[73] Assignee: ASEA Aktiebolag, Vesteras, Sweden

[21] Appl. No.: 672,341

[22] Filed: Mar. 31, 1976

[30] Foreign Application Priority Data

Apr. 2, 1975 Sweden ..... 7503782

[51] Int. Cl.[2] ..... F27D 3/00

[52] U.S. Cl. ..... 13/33; 13/11

[58] Field of Search ..... 13/9 R, 11, 12, 33

[56] References Cited

U.S. PATENT DOCUMENTS

| | | | |
|---|---|---|---|
| 2,744,944 | 5/1956 | Striplin, Jr. et al. | 13/33 X |
| 3,610,795 | 10/1971 | Antoine | 13/9 |
| 3,789,127 | 1/1974 | Bowman | 13/10 X |
| 3,940,551 | 2/1976 | Ling et al. | 13/9 R |

*Primary Examiner*—R. N. Envall, Jr.
*Attorney, Agent, or Firm*—Kenyon & Kenyon, Reilly, Carr & Chapin

[57] ABSTRACT

For the melt reduction of iron oxides, arcs are formed between at least three arcing electrodes in an iron melt, the electrodes being symmetrically positioned about a common vertical axis. The arcs are powered by direct current with the electrodes being cathodic and the melt anodic, and the electrodes are interspaced so closely together that the arcs, due to the direct current powering, converge and form a common focal spot at the electrodes' axis, on the melt, the spot remaining stationary and with any slag on the melt blown away so that the spot is formed by bare metal. Iron oxide material and carbonaceous material, in fine form, is fed downwardly to this spot with the reaction between the oxides and carbon occurring practically immediately.

6 Claims, 1 Drawing Figure

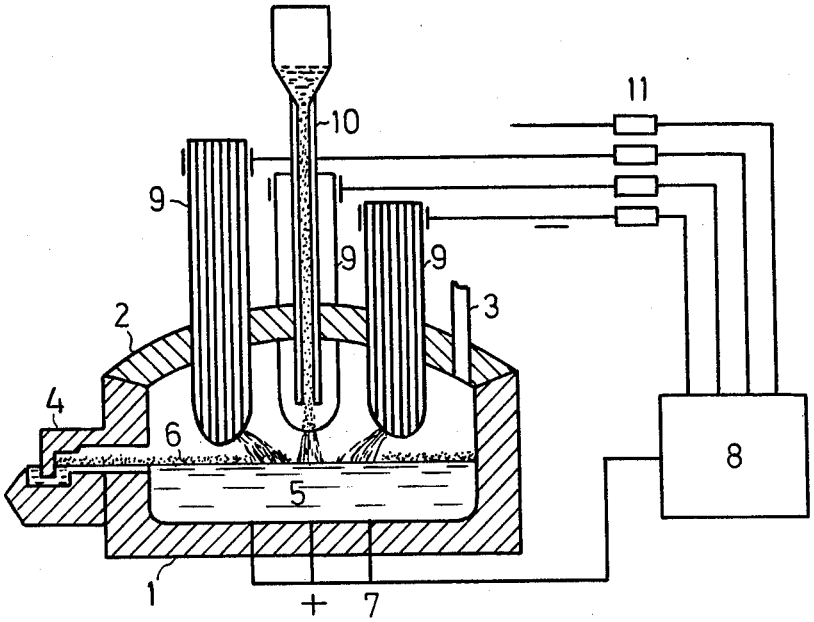
11
10
9
9
9
3
2
4
6
5
8
1
+
7

METHOD AND APPARATUS FOR THE MELT REDUCTION OF IRON OXIDES

BACKGROUND OF THE INVENTION

This invention relates to the melt reduction of iron oxides. U.S. Pat. No. 3,940,551, dated Feb. 24, 1976, and U.S. patent application Ser. No. 588,179, filed June 19, 1975, disclose melt reduction practices wherein, using a DC arc furnace, iron oxide material, such as iron ore, and carbonaceous material, in the form of mixed particles, are fed as directly as possible into an arc formed between a cathodic arcing electrode and an anodic carbonaceous iron melt. In both cases the arcing electrode is made with a longitudinally extending passage through which the materials are fed into the arc formed by the electrode. The direct current arc forms a spot on the iron melt where the slag is displaced to expose bare iron so that the desired reaction between the iron oxides and carbon of the two materials can proceed with maximum rapidity.

The arcing electrode is stationary in the horizontal direction, so the feed of the materials through the electrode is correspondingly stationary in that direction. Therefore, it would seem that the feed of the materials should go directly to the bare spot formed on the melt by the action of the arc.

Unfortunately, it has been found that the arc and, therefore, the spot wanders around in a random fashion in the horizontal direction, this, in turn, meaning that the feed of the materials is sometimes into the bare iron spot and sometimes into slag floating on the melt, because the arc action cannot immediately displace the slag as the arc wanders. This makes the reaction rate between the iron oxides and the carbon an unpredictable variable and not the maximum possible rate desired.

Although not relating to the melt reduction of iron, U.S. Pat. No. 3,789,127, dated Jan. 29, 1974 and U.S. Pat. No. 3,835,230, dated Sept. 10, 1974, disclose that when at least three DC arcing electrodes operating as cathodes, are symmetrically positioned about a common vertical axis above a melt which operates as an anode, the arcs formed between the electrodes and the melt, converge towards the common axis.

SUMMARY OF THE INVENTION

According to the present invention, for the melt reduction of iron oxides, three or more DC arcing electrodes are also positioned symmetrically around a common vertical axis above the iron melt with the electrodes cathodic and the melt anodic, but the electrodes are interspaced so closely together that the converging arcs come to a common focal spot on the iron melt, thus forming the bare iron spot to which the iron oxide material and carbonaceous material, preferably intermixed, are fed, in this case by a water-cooled lance positioned concentrically with the common axis of the electrodes. With the electrodes thus positioned, the spot of bare iron melt is a stationary spot which does not wander and to which the materials can be fed accurately, providing for a constant reaction rate between the iron oxides and the carbon present. In turn, this permits the relative proportions of intermixed iron oxide and carbon materials to be adjusted so that at the stationary spot of bare metal, a substantially complete reaction between the oxide and carbon is obtained without leaving a residue of either the oxides or the carbon.

The electrodes are positioned so closely together to obtain the common focal point forming the bare spot of iron, so as to raise the question of possible arc-over from one electrode to the other. However, this can be prevented by adjusting the voltages of the currents applied to the multiplicity of electrodes, so that they are substantially the same.

By using fine-grained or powdered iron oxide material and carbonaceous material which are intermixed, and by proportioning the relative amounts of these materials, it is possible to obtain a complete and immediate reaction at the stationary bare spot of iron, the reaction being substantially complete and leaving no residue of either, other than for slag formation resulting from components other than the oxide and carbon. If the iron melt is carbonaceous, it should be considered that its carbon may possibly provide some reducing action.

As an incidental but important advantage, when an even number of the electrodes are positioned closely together, they shade or shield much of the refractory lining of the electric furnace that must be used in the practical practice of the present invention, from the radiation of the multiple arcs, the arc angularities, due to their direct current operation described, all being inwardly towards the common axis of the arcing electrodes. This shading of the inwardly directed arc flares by the arcing electrodes, obtained to a lesser degree when only three electrodes are used, substantially reduces arc radiation damage to the refractory lining of the furnace used to practice this invention. This shading action can be enhanced by the use of arcing electrodes of the Soderberg type, because this type necessarily has a larger diameter than solid graphite electrodes of equal capacity.

It is to be understood that the three or more arcing electrodes are interspaced as closely as possible as the normal electrode holders of an electric furnace permits. The feeding lance can extend downwardly through the usual furnace roof concentrically with the common axis of the arcing electrodes, for feeding the materials to the stationary spot of bare metal maintained on the melt's surface.

BRIEF DESCRIPTION OF THE DRAWING

An example of an electric furnace construction embodying the principles of the present invention is schematically illustrated in vertical section by the single view shown.

DETAILED DESCRIPTION OF THE INVENTION

Referring to the above drawing, a furnace vessel 1 having the usual roof 2, only the refractory linings being shown, is provided with a gas exhaust pipe 3 extending through the roof, and a slag-retaining discharge 4 for the iron melt 5 which is of increasing volume, the iron melt leaving the furnace while slag 6 is retained in the furnace vessel. Centrally located hearth or melt connections 7 are electrically connected with a DC power source 8 so that the melt 5 forms an anode, and four vertical arcing electrodes 9 of the Söderberg type are positioned vertically movably through the furnace vessel roof 2, a water-cooled lance 10 also being positioned through the roof and defining a vertical axis about which the vertical arcing electrodes 9 are symmetrically positioned concentrically with respect to the lance 10. Each electrode, of which one is not shown because of the view, is separately connected for cathodic operation with the power source 8, each connection having a DC voltage controller 11 so that the voltages on each electrode can be kept the same throughout the group to prevent arc-over between the electrodes, even though they are spaced as closely together as the electrode holders (not shown) can permit. It is to be understood that the electrode holders may be of the usual kind permitting vertical adjustments of the various arcing electrodes, with the precision required to maintain equal voltages on all of the electrodes and to provide for control of the reaction rate proceeding on the part of the oxides and carbon of the intermixed materials in powder form fed to the previously referred to spot, shown at 5, where the surface of the melt 5 is maintained free from the slag 6 with the spot being stationary as previously noted. The lance 10 can be fed by a suitable feeder as is indicated on the drawing.

Recognizing that particularly in the case of the iron oxides, the material may be iron ore, possibly pretreated for partial reduction, and that the carbonaceous material may, for example, be carbon, with all of the materials in powdered form, the iron oxide and carbon being proportioned for complete reaction without leaving an excess of either component, the mixture is fed to the spot 5 at a constant rate known from testing to provide for complete reaction, insofar as this is possible. The arcing electrodes 9 are fed downwardly as required to keep the various arcs uniform in their power-draw. In the drawing, these arcs are shown converging to form the focal point providing the spot of bare iron and which is, in this case, fixed or stationary. Resulting gases are exhausted via the pipe 3, the increasing volumes of the melt 5 providing a discharge through the slag-retaining run-out 4. Slag formation is reduced because of the complete reaction between the oxides and carbon.

As can be seen from the drawing, the flare of the lefthand one of the four arcs is shaded by the righthand one of the arcing electrodes 9, and vice versa. The use of only three electrodes does not provide such effective shading and, therefore, it is considered preferable to use at least four arcing electrodes. The angularly deflected arcs formed inherently by grouped cathodic arcing electrodes, can produce arc flares of directional characteristics which can be particularly damaging to a refractory furnace lining, so this shading action described, is of importance.

What is claimed is:

1. A method for the melt reduction of iron oxide material, comprising forming arcs between at least three substantially vertical arcing electrodes and an iron melt, said electrodes being substantially symmetrically positioned about a common substantially vertical axis, said arcs being powered by direct current with the electrodes forming cathodes and said melt forming an anode, said electrodes being interspaced so closely together that said arcs converge and form a substantially common focal spot at said axis on said melt, said spot being substantially stationary and being maintained by said arcs substantially free from any slag floating on said melt, and feeding particles of said material and of carbonaceous material to said spot.

2. The method of claim 1 in which said electrodes are maintained at substantially the same electrical potential preventing arc-over from one electrode to another.

3. The method of claim 2 in which said particles have such a small particle size and relative proportions as to cause at said spot substantially immediate reaction between the iron oxides of said iron oxide material and the carbon content of said carbonaceous material without leaving a substantial residue of either the oxides or the carbon.

4. A direct current electric arc furnace for the melt reduction of iron oxides and comprising a furnace having a lower portion forming a hearth having a melt-discharge opening, an electric connection for a melt in said hearth, at least three substantially vertical arcing electrodes substantially symmetrically positioned about a common substantially vertical axis and with bottom ends positioned to form arcs with a melt in said hearth, said electrodes being interspaced closely together so that when operated cathodically, they form arcs converging to a common focal point on a melt in said hearth, and a lance extending downwardly concentrically with said axis for feeding iron oxide material and carbonaceous material particles to said focal point.

5. The furnace of claim 4 having a direct current power source connected anodically with said electric connection, and connected cathodically to said electrodes, each electrode having means for controlling the voltage of current transmitted thereto from said source.

6. The furnace of claim 4 having an even number of said electrodes so as to each two electrodes one shades arc flare from another.

* * * * *